US006896264B1

(12) United States Patent
Haber

(10) Patent No.: US 6,896,264 B1
(45) Date of Patent: May 24, 2005

(54) METHOD OF PLAYING A DICE WAGERING GAME

(76) Inventor: Jose Cherem Haber, Paseo de las Palmas 1260, Mexico D.F. (MX) 11000

( * ) Notice: Subject to any disclaimer, the term of this patent is extended or adjusted under 35 U.S.C. 154(b) by 0 days.

(21) Appl. No.: 10/650,161

(22) Filed: Aug. 27, 2003

(51) Int. Cl.[7] ..... A63F 9/04
(52) U.S. Cl. ..... 273/274; 273/138.1; 273/309; 463/22
(58) Field of Search ..... 273/146, 274, 273/309, 138.1, 138.2; 463/22

(56) References Cited

U.S. PATENT DOCUMENTS

| | | | | |
|---|---|---|---|---|
| 2,577,087 | A * | 12/1951 | Meeks | 273/145 D |
| 3,399,897 | A * | 9/1968 | Mitchell | 273/146 |
| 4,921,249 | A * | 5/1990 | Kropkowski et al. | 273/256 |
| 5,487,547 | A * | 1/1996 | Hobert | 273/274 |
| 5,662,330 | A | 9/1997 | Spears | |
| 5,964,463 | A * | 10/1999 | Moore, Jr. | 273/274 |
| 6,070,872 | A | 6/2000 | Squitieri | |
| 6,234,482 | B1 | 5/2001 | Henderson | |
| 6,601,848 | B1 * | 8/2003 | Timmons, Sr. | 273/146 |
| 2003/0030216 | A1 | 2/2003 | Endoso | |

OTHER PUBLICATIONS

"Under And Over Seven", Scarne's Complete Guide To Gambling by John Scarne, Simon And Schuster, 1961, pp. 451-452.*

* cited by examiner

*Primary Examiner*—Benjamin Layne
(74) *Attorney, Agent, or Firm*—Rob L. Phillips; Quirk & Tratos

(57) ABSTRACT

A wagering game utilizing a table game layout and multiple dice is disclosed. The game allows players to place wagers on whether the sum of multiple rolled dice will be higher or lower than a preestablished value. When using two dice the preestablished value is seven. The "higher" or "lower" wagers are based on two consecutive rolls of the dice. In other words, the "higher" and "lower" wagers are won if the sum of the two dice on two consecutive rolls is above seven or falls below seven, respectively. For example, successive rolls of eleven and twelve result in a winning "higher" wager. Larger payouts are associated with winning "higher" or "lower" wagers predicated on two consecutive identical sums. Players may also wager on single roll outcomes. Such single roll outcomes include a seven/eleven, two/three and eleven/twelve wager. The game is also implementable in an electronic version.

11 Claims, 5 Drawing Sheets

400

| 420 WAGER | 430 OUTCOME | 440 PAYOUT | 410 HOUSE EDGE |
|---|---|---|---|
| 2/3 | 2 OR 3 | 10 TO 1 | 8.3% |
| 11/12 | 11 OR 12 | 10 TO 1 | 8.3% |
| 7/11 | 7<br>11 | 1 TO 1<br>10 TO 1 | 5.6% |
| HIGHER | ANY TWO NON-IDENTICAL HIGHER #s<br>8 AND 8<br>9 AND 9<br>10 AND 10<br>11 AND 11<br>12 AND 12 | 3 TO 1<br>4 TO 1<br>6 TO 1<br>10 TO 1<br>25 TO 1<br>100 TO 1 | 5.8% |
| LOWER | ANY TWO NON-IDENTICAL LOWER #s<br>6 AND 6<br>5 AND 5<br>4 AND 4<br>3 AND 3<br>2 AND 2 | 3 TO 1<br>4 TO 1<br>6 TO 1<br>10 TO 1<br>25 TO 1<br>100 TO 1 | 5.8% |

FIG. 4

METHOD OF PLAYING A DICE WAGERING GAME

FIELD OF THE INVENTION

The embodiments of the present invention relate to a method of playing a dice wagering game.

BACKGROUND

As legalized gaming continues to burgeon around the world, particularly in the. United States, the need for new games of chance likewise proliferates. Indeed, creative minds are utilizing a great deal of energy to develop new wagering games conducive to a casino environment. Unfortunately, to date, a vast majority of the new games have not found their way onto casino floors. The reasons for such failures typically relate to common wagering game shortcomings.

The common shortcomings include, slow pace of play, complex rules, poor player odds and, in some cases, the lack of a significant jackpot or large payout opportunity. Focusing on table games, one discovers that casinos throughout the United States offer a limited choice of the same table games. The limited game choices comprise Blackjack, Craps, Roulette, Carribean Stud® Poker, Let it Ride®, Three Card Poker, Pai Gow Poker, Casino War, Baccarat and others. In addition, many casinos offer variations of the aforementioned games. Even with the limited number of existing table games and ever-increasing pool of new games, casinos have been slow to integrate new table games. As mentioned above, one reason for the slowness has been the lack of viable new table games. A second reason is the increased popularity of electronic wagering games. Based on the popularity of electronic gaming machines, casinos have apportioned a higher percentage of their floor space for electronic gaming machines (naturally less floor space is then apportioned for table games). Of course, in almost all cases, table games can be implemented in an electronic version as well. Thus, a viable table game can also provide a complimentary electronic gaming machine embodiment.

Obviously, to be successful new table games must avoid the shortcomings set forth above. Moreover, the games must be exciting to play, have simple rules and provide reasonable player odds. It is also beneficial for the games to use common gaming props (e.g., playing cards or dice) and to provide a jackpot or large payout opportunity. In addition, casinos desire new table games which allow their existing tables to be utilized thereby decreasing the costs to the casinos. For example, if a new card game layout can be accommodated by an existing Blackjack table, it is more attractive to the casino.

Thus, there continues to be a need for new wagering games exhibiting the aforementioned characteristics which are implementable in both a live embodiment and electronic gaming machine embodiment.

SUMMARY

Accordingly, the embodiments of the present invention provide a wagering game having the advantageous characteristics sought by casinos. Moreover, the live table game embodiments of the present invention are facilitated by existing Craps tables.

In a live embodiment of the present invention, a table game layout and two dice form the basis for a wagering game. The underlying concept of the game is to wager on whether the sum of two dice on consecutive rolls will be higher than seven or lower than seven. Players are also provided with opportunities to wager on specific one roll dice combinations, such as seven and eleven, two and three and eleven and twelve.

The higher and lower wagers are based on two consecutive rolls of the dice. Therefore, to win a "higher" wager, the sum of the two dice on consecutive rolls must exceed seven. For example, a first roll of eight and second roll of nine qualifies as a winning "higher" wager. If either roll is seven or less, the "higher" wager is lost. Similarly, a winning "lower" wager requires that the sum of the two dice on consecutive rolls be less than seven. For example, a first roll of six and a second roll of three qualifies as a winning "lower" wager. In one embodiment, winning "higher" and "lower" wagers are paid 3 to 1.

Other payouts correspond to the single roll wagers on seven or eleven, two or three and eleven or twelve. Obviously, other single roll dice sums can be the subject of wagers and corresponding payouts.

To increase the level of excitement, larger payouts correspond to consecutive winning "higher" and "lower" rolls which are identical. For example, should the winning "higher" rolls both be eleven, the payout increases from 3 to 1 to 25 to 1. Similarly, should the winning "lower" rolls both be two, the payout increases from 3 to 1 to 100 to 1.

Other embodiments, modifications and variations are evident from the corresponding drawings, detailed description and claims as set forth herein.

BRIEF DESCRIPTION OF THE DRAWINGS

FIG. 4 illustrates a table depicting a house edge associated with certain wagers.

DETAILED DESCRIPTION

Figure 1:
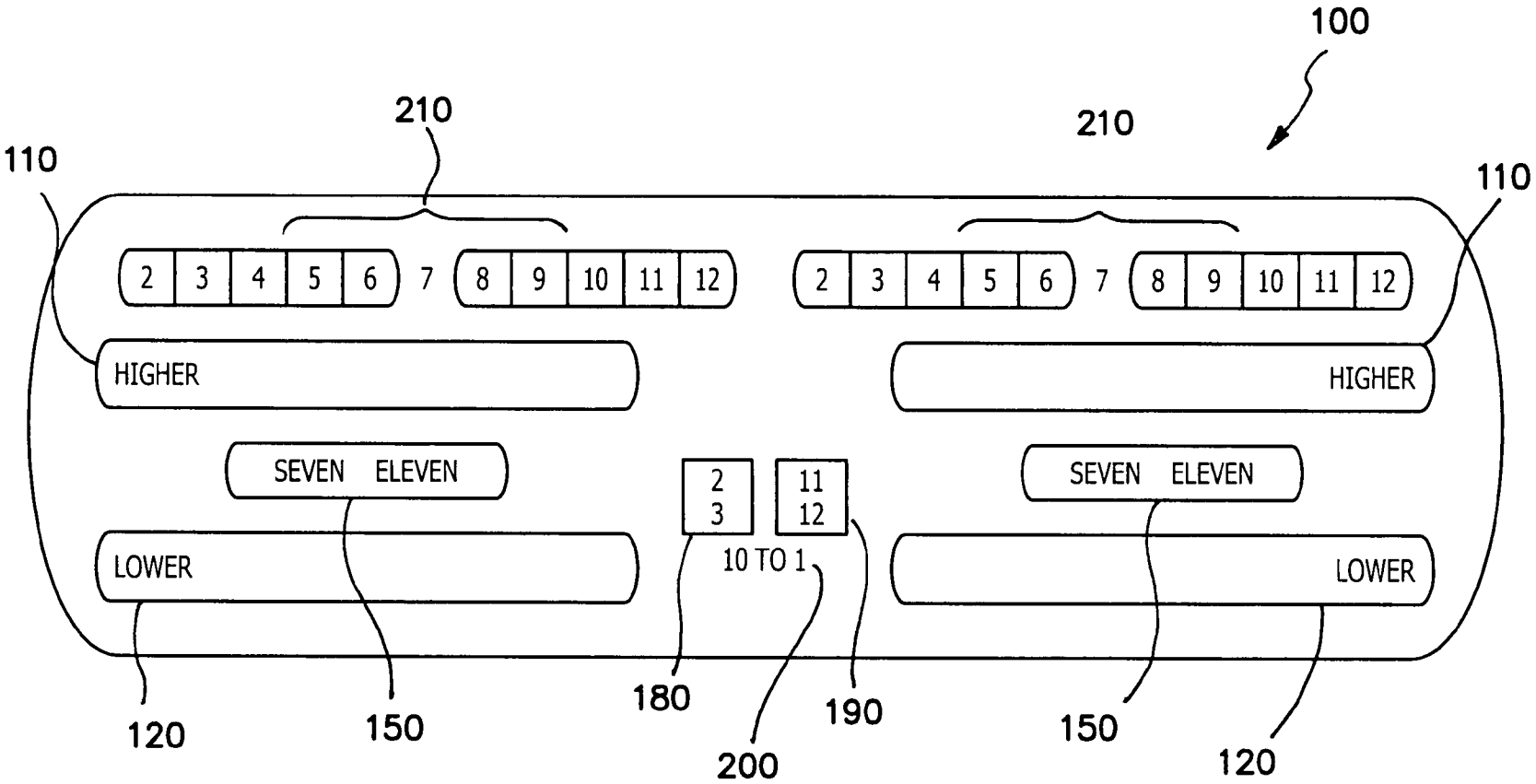
FIG. 1 illustrates a full gaming table layout which may be used to facilitate live embodiments of the present invention.
Figure 1A:
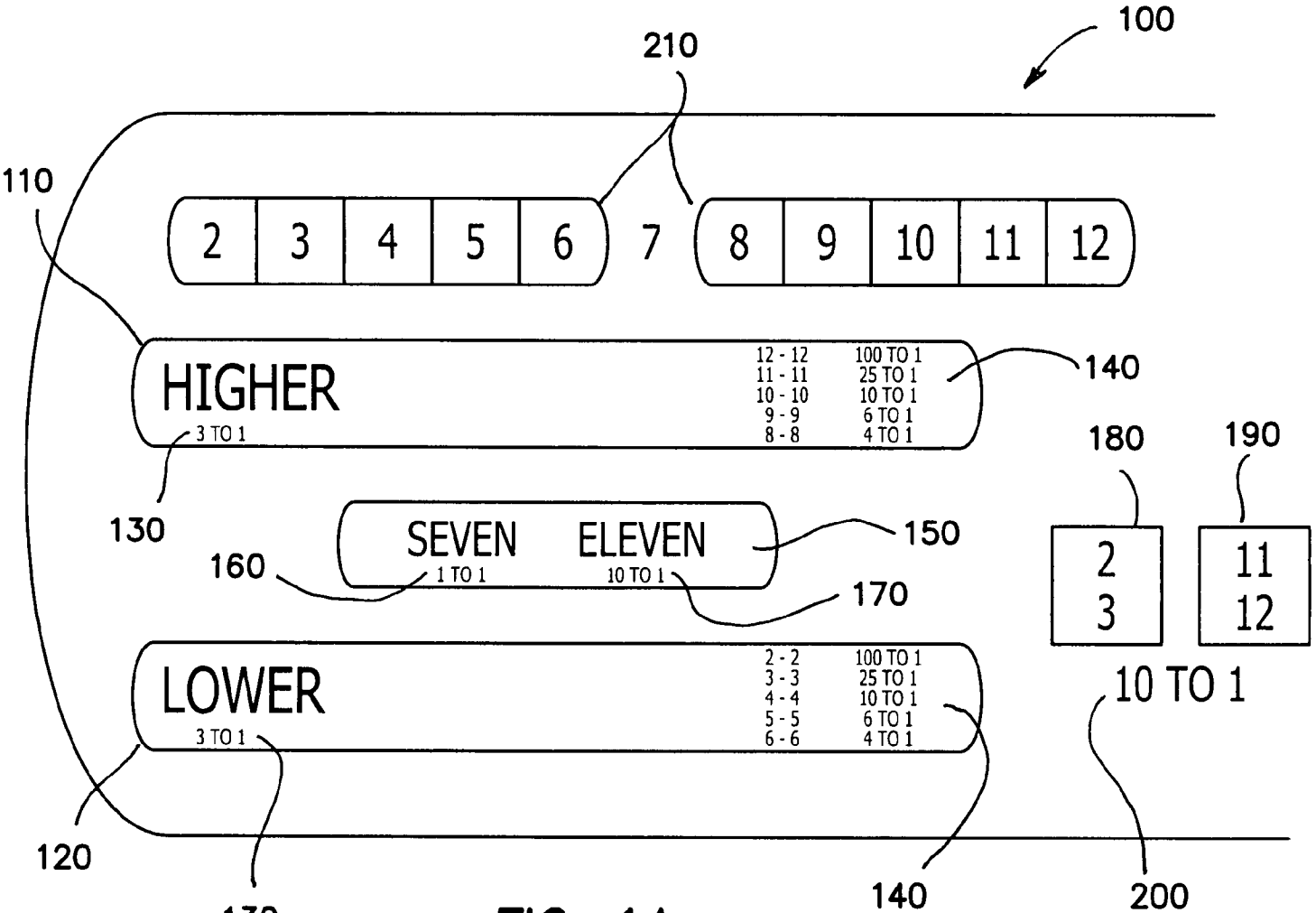
FIG. 1A illustrates one-half of the gaming table layout further depicting wager payouts.

Reference is now made to the figures wherein like parts are referred to by like numerals throughout. FIGS. 1 and 1A illustrate a gaming table layout generally denoted as reference numeral 100. FIG. 1 shows the full layout 100 which FIG. 1A is close-up view of the layout 100 further depicting the wagering payouts. To reduce casino costs and for ease of use, the cloth layout 100 is designed to conform to the dimensions of a conventional Craps table. It is envisioned that, like Craps, dealers, croupiers and stickmen will work the table. Their duties include paying winning wagers, collecting losing wagers, operating a display device, explaining game rules and generally interacting with players.

Wager areas 110 and 120 correspond to "higher" and "lower" wagers, respectively. Each "higher" and "lower" wager area 110, 120 incorporates the payouts associated with winning the respective wager. To win the "higher" or "lower" wager requires the sum of two dice on consecutive rolls to be more than seven or less than seven, respectively.

Therefore, a winning "higher" wager may comprise a first roll of nine and a second roll of ten. Likewise, a winning "lower" wager may comprise a first roll of six and a second roll of two. In the aforementioned examples, the payout 130 for a winning "higher" or "lower" wager is 3 to 1. A 5 to 4 payout is provided for players who, after a first successful "higher" or "lower" roll, decide to quit play or collect early on their two roll "higher" or "lower" wager.

In the event the consecutive winning "higher" rolls or "lower" rolls are the same (e.g., eight/eight or three/three, respectively), alternative payouts 140 are provided. The alternative payouts 140 as shown can be as large as 100 to 1 or more depending on the desires of the particular casino. Such large payouts are attractive to players and add anticipation and excitement to the live embodiment of the game.

Along with the "higher" and "lower" wager areas 110, 120 is a seven/eleven wager area 150. The wager area 150 incorporates payouts 160 and 170. The payouts 160, 170, unlike the payouts 130, 140, correspond to the outcome of a single roll of the two dice. Therefore, on a single wager, a roll of seven pays 1 to 1 (i.e., even money) and a roll of eleven pays 10 to 1. The roll of eleven qualifies as a "higher" outcome as well.

Wager areas 180 and 190 also correspond to single roll wagers on combinations of two numbers. Specifically, wager area 180 corresponds to a single roll wager on an outcome of two or three. Similarly, wager area 190 corresponds to a single roll wager on an outcome of eleven or twelve. Both wagers have a payout 200 of 10 to 1. While the payouts 130, 140, 160, 170 and 200 are depicted on the layout 100, they can alternatively be shown on game brochure or displayed on a placard proximate the layout 100.

Running along the layout 100, above and adjacent to the "higher" wager area 110, is a number index 210 for tracking the "higher" and "lower" wagers. The tracking assists both players, dealers, stickmen and croupiers with the resolution of the "higher" and "lower" wagers. In a first embodiment, the wagers placed on either the "higher" and "lower" wagers areas 110, 120 are moved (or marked as discussed below) to the square of the number index 210 corresponding to the rolled number. Wagers moved (or alternatively marked) to the number index 210 remind the dealers and/or croupiers that their resolution depends on the following dice roll. It also functions to record the first rolled number so that a second identical rolled number activates an enhanced payout 140.

Like Craps, dealers and/or croupiers keep track of player wagers by placing each player wager in each wager area according to the player's position around the table. Thus, if a first roll outcome is an eight, the dealer and/or croupier moves (or alternatively marked) all of the "higher" wagers to the eight square on the number index 210. Each player wager is positioned on the eight square corresponding to the player's position about the table. Any "lower" wagers are collected as losing wagers. The "lower" wagers are moved (or alternatively marked) to the number index 210 and the "higher" wagers are collected when the first roll is a number less than seven. If a seven is rolled, all "higher" and "lower" wagers are collected as losing wagers.

Alternatively, the player wagers remain in the "higher" or "lower" wager area 110, 120 and are marked (or moved as discussed above) with a coin, chip or other indicator to signify that their resolution depends on the following dice roll. For example, after a first roll, each wager in the "higher" or "lower" wager area 110, 120 is marked with a red chip indicating that the wager is dependent upon the next roll. The next round of wagers placed in the "higher" and "lower" wager areas 110, 120 can be left uncovered or covered with an alternatively colored chip indicating that they are only on their first roll.

Figure 2:
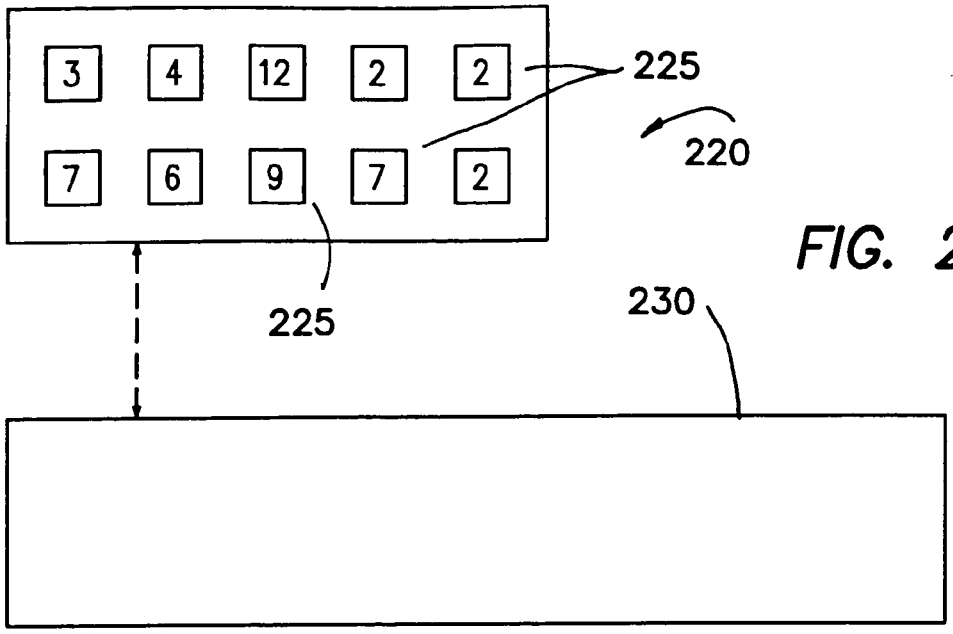
FIG. 2 illustrates a block diagram of a table and display arrangement for enhancing the features of the live embodiments of the present invention.

As shown in FIG. 2, a display device 220 proximate the table 230 is used to record the outcomes 225 of a preestablished number of prior rolls. Such a system is similar to Roulette which incorporates a display device for displaying the previous twenty or more game outcomes. The display 220 is controlled by the dealer and/or croupier with a number input pad (not shown) in communication with the display 220. The arrangement of the numbers on the display 220 can take any form as long as it allows players to discern the previous game outcomes (i.e., dice sums). Players often use displayed game outcomes to decide which types of wagers to make. It also contemplated that elevated signage (not shown) can be placed nearby the table 230 to inform patrons of the game name and to generally attract new players.

Figure 3:
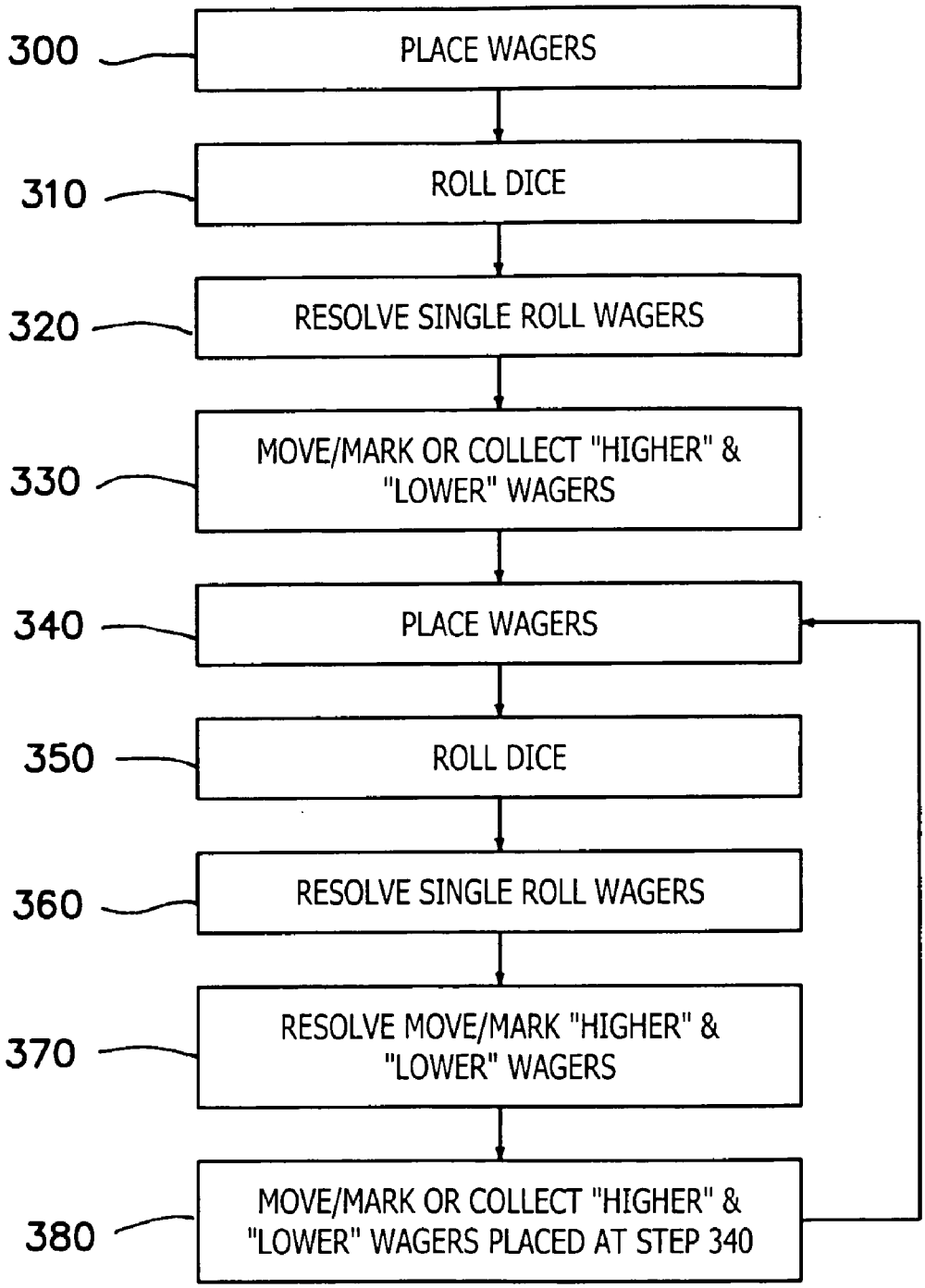
FIG. 3 illustrates a flow chart outlining a sample play of one embodiment of the present invention.

Now referring to FIG. 3, a flow chart is used to outline one embodiment of the present invention. At step 300, wagers are placed. At step 310, the two dice are rolled by a selected player. Ideally, each player is permitted to roll until a seven appears and then the dice are passed to an adjacent player in a clockwise fashion. Alternative dice rolling schemes are obviously possible. At step 320, the dealers and/or croupiers resolve the single roll wagers, such as the wagers on the seven/eleven, the two/three and the eleven/twelve. At step 330, the "higher" and "lower" wagers are either moved/marked or collected. That is, if the outcome of the roll is in the "higher" group, the "higher" wagers are moved to the number index 210 or marked and the "lower" wagers are collected as losing wagers. If a seven is the outcome of a first roll, both the "higher" and "lower" wagers are collected as losing wagers. At step 340, players place new wagers. At step 350, the two dice are rolled again by the selected player. At step 360, the dealers and/or croupiers resolve the new single roll wagers. At step 370, the dealers and/or croupiers resolve the moved or marked wagers. At step 380, the new "higher" or "lower" wagers placed at step 340 are moved or marked. The flow chart now loops back to step 340 for new wagers to be placed. It is noted that the flow chart steps are illustrative and can be rearranged without altering the game.

FIG. 4 illustrates a table 400 listing the house edge 410 corresponding to wager types 420, outcomes 430 and associated payouts 440 as depicted on the layout 100 as shown in FIG. 1A. The payouts shown in FIG. 1A and FIG. 4 are illustrative only and the actual offered payouts and therefore house edge will ultimately be determined by the casino offering the embodiments of the present invention to its patrons.

Figure 5:
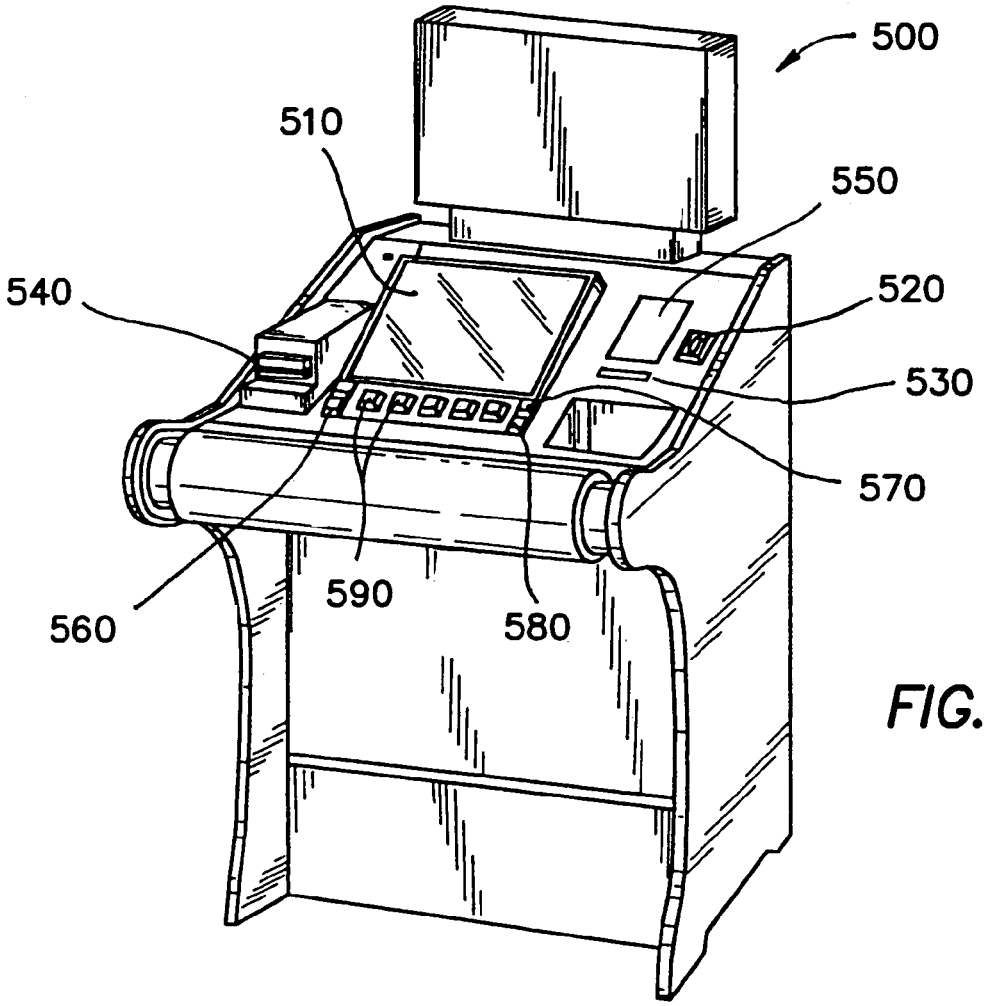
FIG. 5 illustrates a gaming machine for facilitating an electronic version of the present invention.

FIG. 5 illustrates a gaming machine 500 for implementing the present invention in an electronic format. The operation of electronic gaming machines, including slot machines and video poker machines, is well known in the industry so that the minute details are not set forth herein. In general terms, electronic gaming machines are controlled by processors including, or in communication with, a random number generator. The random number generator generates the machines' outcomes. In this case, the rolls of the dice. A display in communication with the processor provides visual and graphic information to players. The processor then controls the game, including tracking wagers and payouts.

The general external features of the gaming machine 500, include a display 510, coin slot 520, a bill reader 530, a card reader 540 and a credit display 550. The gaming machine 500 also includes several player buttons which act as interfaces between the player and the machine processor. Player buttons include a one coin wager button 560, a maximum coin wager button 570, wager selection buttons 580 and a roll the dice button 590. While not shown, the machine 500 may also incorporate a ticket dispenser for printing tickets for redemption at a cashier window. Such cashless systems are becoming increasingly popular in most gaming jurisdictions. It is noted that any of the functions facilitated by the gaming machine buttons 560–590 can be accomplished by a display employing touchscreen technology.

As described thus far, the two dice have been conventional dice having six faces. Each die face includes a different number of pips from one to six. It is conceivable that unconventional dice could be used to facilitate variations of the embodiments of the present invention without departing from the spirt or scope of the present invention. For example, dice are available with a multitude of faces (e.g., twelve), such dice could be used to facilitate wagers on whether the sum was higher or lower than a value other than seven depending on the possible outcomes of the selected dice. In addition, more than two conventional dice can be used to increase the complexity of the present invention. More particularly, with three conventional dice, players could wager on whether the sum is higher than eleven, lower than ten or exactly ten or eleven. Many modifications can be achieved by selecting unconventional dice and/or altering the number of dice used.

It is to be understood that even though numerous characteristics of the present invention have been set forth in the foregoing description, together with an explanation of various possible embodiments and modifications thereto, this disclosure is illustrative only and changes may be made within the spirit of the invention to the full extent indicated by the broad general meaning of the terms in which the appended claims are expressed.

I claim:

1. A method of playing a wagering game comprising:

accepting one or more high or low wagers;

allowing a player to roll two or more dice two or more times before wagers are resolved; and resolving said high and low wagers, said high wager being won if the sum of each of the two or more individual rolls are both higher than a pre-established value and said low wager being won if the sum of each of the two or more individual rolls are both lower than the pre-established value.

2. The method claim 1 further comprising accepting a wager on a single roll of the dice having a sum equal to the pre-established value.

3. The method of claim 1 wherein payouts associated with winning high and low wagers are greater when each of two or more rolls has the same sum.

4. The method of claim 1 further comprising displaying a record of the sums of each dice roll.

5. The method of claim 1 wherein two six-sided dice are rolled and the pre-established value is seven.

6. The method of claim 1 wherein the dice are rolled on a craps table having a modified gaming table layout.

7. The method of claim 6 further comprising moving said high or low wagers to a number index on said layout in response to a first roll higher than the pre-established value or lower than the pre-established value, respectively.

8. The method of claim 1 wherein two dice are rolled and further accepting single roll wagers on number combinations of seven and eleven, two and three and eleven and twelve.

9. A method of playing a wagering game comprising:

accepting high or low wagers;

allowing a player to roll two dice two consecutive times before wagers are resolved;

resolving said high and low wagers, said high wager being won if the sum of the first roll of the two dice and the sum of the second roll if the two dice are each higher than seven and said low wager being won if the sum of the first roll if the two dice and the sum of the second roll if the two dice are each lower than seven.

10. The method of claim 9 wherein payouts associated with the high and low wagers are increased in the event the two winning rolls of the dice have the same sum.

11. The method of claim 9 further comprising accepting and resolving wagers based on single rolls of the dice.

* * * * *

UNITED STATES PATENT AND TRADEMARK OFFICE

CERTIFICATE OF CORRECTION

PATENT NO. : 6,896,264 B2
DATED : May 24, 2005
INVENTOR(S) : Jose Cherem Haber

It is certified that error appears in the above-identified patent and that said Letters Patent is hereby corrected as shown below:

Column 6,
Line 30, after "second roll", change "if" to -- of --.
Line 32, after "first roll" change "if" to -- of --.
Line 33, after "roll" change "if" to -- of --.

Signed and Sealed this

Twenty-third Day of August, 2005

JON W. DUDAS
*Director of the United States Patent and Trademark Office*